United States Patent [19]

Kervistin et al.

[11] Patent Number: 4,662,821

[45] Date of Patent: May 5, 1987

[54] AUTOMATIC CONTROL DEVICE OF A LABYRINTH SEAL CLEARANCE IN A TURBO JET ENGINE

[75] Inventors: Robert Kervistin, Le Mee sur Seine; Philippe J. Lefebvre, Paris; Alain F. Teissier, Le Mee sur Seine, all of France

[73] Assignee: Societe Nationale d'Etude et de Construction de Moteur d'Aviation S.N.E.C.M.A., Paris, France

[21] Appl. No.: 780,457

[22] Filed: Sep. 26, 1985

[30] Foreign Application Priority Data

Sep. 27, 1984 [FR] France ..... 84 14819

[51] Int. Cl.[4] ..... F01D 11/08

[52] U.S. Cl. ..... 415/170 R; 415/116

[58] Field of Search ..... 415/170, 174, 171, 175, 415/176, 134, 115, 116, 172 A

[56] References Cited

U.S. PATENT DOCUMENTS

| | | | |
|---|---|---|---|
| 2,685,429 | 8/1954 | Auyer | 415/116 |
| 3,989,410 | 11/1976 | Ferrari | 415/116 |
| 4,157,880 | 6/1979 | Klompas | 415/115 |
| 4,190,397 | 2/1980 | Schilling et al. | 416/244 A |
| 4,213,296 | 7/1980 | Schwarz | 415/116 |
| 4,222,706 | 9/1980 | Ayache et al. | 415/116 |
| 4,222,707 | 9/1980 | Drouet et al. | 415/116 |
| 4,466,239 | 8/1984 | Napoli et al. | 415/116 |
| 4,554,789 | 11/1985 | Napoli et al. | 415/112 |
| 4,571,937 | 2/1986 | Albers | 415/115 |

FOREIGN PATENT DOCUMENTS

| | | |
|---|---|---|
| 955993 | 1/1950 | France . |
| 2280791 | 2/1976 | France . |
| 2292868 | 6/1976 | France . |
| 2437544 | 9/1978 | France . |
| 2449789 | 11/1979 | France . |
| 158918 | 3/1933 | Switzerland . |
| 1525746 | 10/1975 | United Kingdom . |
| 1484288 | 9/1977 | United Kingdom . |
| 2,042,086 | 9/1980 | United Kingdom . |

*Primary Examiner*—Abraham Hershkovitz
*Assistant Examiner*—John Kwon
*Attorney, Agent, or Firm*—Oblon, Fisher, Spivak, McClelland & Maier

[57] ABSTRACT

Apparatus associated with a labyrinth seal of a turbo machine for automatically maintaining a desired clearance between lip members and a wear seal of the labyrinth seal over a range of operational states of the turbo machine. The wear seal comprises a first part made of honeycomb material and a second smooth part spaced axially from the first part. An annular carrier supports the wear seal, and a stator supports the carrier, thereby defining between the carrier and the stator an annular chamber having radially outer orifices for admission of an air supply to the chamber. An annular sheet member disposed within the annular chamber has a plurality of holes and is spaced at a small distance from the carrier. Whereas acceleration and deceleration of the turbo machine normally would tend to alter the spacing of the wear seal and the lip members, the structure recited above corrects for this effect, thereby maintaining a desired clearance between the wear seal and the lip members.

3 Claims, 4 Drawing Figures

AUTOMATIC CONTROL DEVICE OF A LABYRINTH SEAL CLEARANCE IN A TURBO JET ENGINE

BACKGROUND OF THE INVENTION

1. Field of the Invention

This inevntion relates to an automatic control device operative to adjust the clearance in a seal of the labyrinth type of a turbo-machine.

2. Discussion of the Background

Fluid-tightness between fixed and rotary parts of turbo machines frequently make use of seals of the labyrinth type comprising, on the one hand, on the rotary part, members in the form of small tips, having a number varying in dependence upon the operational conditions and in accordance with various technological parameters, and, on the other hand, on the fixed part lying opposite thereto, a member forming a wear and fluid-tight seal termed an "abradable", that is to say wearable as a result of friction during possible contact with a tip without giving rise to appreciable damage to the latter, this wear seal member being carried by an annular carrier connected to a fixed structure of the turbo machine. Such labyrinth seals can be disposed, for example, between various rotary stages of a compressor or of a turbine, and fixed parts (or rotary at a different speed) adjacent thereto. The tips are in these cases supported by distance pices or rings and the wear seal member is secured on the stator (or in the rotary part preferably having the lower speed).

In another specific use of the labyrinth seals which provides a more direct application envisaged by the invention, these seals are disposed between various enclosures of the turbo-machine and they are to be found particularly at the end of an outer enclosure of the combustion chamber casing, on the one hand, the side of the outlet of the compressor and, on the other hand, the side at the inlet of the turbine. In this case the correct fluid-tight operation of the seal is more complex. In practice a pressure balance between the various enclosures of the turbo-machine is normally sought. A controlled flow of air is also desired in the enclosures with a view to creating particular air currents for cooling eventually usable in other zones of the turbo machine and thus it may be desirable to control with the highest precision the air flows termed "loss flows" traversing this type of labyrinth seal and of which the control reflects on the various results such as the efficiencies of the turbo machine or the useful life of the various parts. Apart from various operational conditions, such as the pressures in the enclosed spaces, one of the fundamental parameters on which this air flow control depends is the clearance during operation between the upper parts of the tips and the wear seal member.

Various proposals for overcoming the problems which have been posed have been put forward and in particular for maintining a controlled value for the clearance between the tips and the wear seal member in a labyrinth seal, such that they will be maintained under operational conditions of the turbo-machine, both at a stabilized rating or during transitory rating phases. Thus, in FR-A-2 437 544 in the name of the present Applicant a labyrinth seal is described in which the carrier of the wear seal member is surrounded by an annular duct connected, at its downstream end, to an air supply provided in the wall of the combustion chamber casing whilst its other end discharges upstream of the labyrinth seal member into space at a lower air pressure surrounding the compressor shaft. The control of the amount of air flow for cooling the seal makes use in this case of an adjustable discharge vane operative on the basis of an operational parameter of the turbo machine. This mode of control has nevertheless various disadvantages inherent in the method because it relies, on the one hand, on a derivative of a complex chain of control thus multiplying the risks of an accident or defective operation arising from the vanes and other accessories and, on the other hand, the response times, particularly during the transitory phase ratings, thus risking too great delay for ensuring totally satisfactory operation.

Another known device according to FR-A-2 449 789 seeks to achieve cooling of a labyrinth seal disposed downstream of a turbo machine compressor and provided with this aim with passages traversing the stator of the seal through which is supplied cooling air delivered between two upstream teeth of the rotor of the seal.

In accordance with GB-A-1 525 746, labyrinth seals are disposed successively from upstream in the downstream direction in the three zones disposed radially-inwardly of the downstream part of a combustion chamber and radially-inwardly of the inlet guide vane array of the associated turbines. In order to reduce the overall losses produced by the labyringth seals, the device described collects the losses derived from the first two labyrinth seals and reintroduces this air into the third labyrinth seal between the teeth of the rotor of the seal derived from apertures traversing the stator of this seal.

SUMMARY OF THE INVENTION

The invention brings into association novel charactersitcs together with known elements whilst avoiding the disadvantages of previous proposals and by novel means gives rise to important results. It relates in particular, to an arrangement applicable during build up to operation at full gas during rapid acceleration, of ensuring a minimum clearance between the upper part of the tips and the cooperating surface of the wear seal member of the labyrinth seal and also, in the case of a rapid deceleration, of avoiding any penetration of the lips into the wear layer, which would otherwise give rise to various mechanical disadvantages (vibration phenomena) and heating up which in turn gives rise to various phenomena, the generation eventually of clearances which are too great and are prejudicial to efficiencies. During this latter transitory phase of deceleration, in practice, a minimum clearance must be maintained in order to allow for a rapid return to re-acceleration conditions.

According to the present invention there is provided in a turbo-machine a device for automatic control during operation of the clearance of a labyrinth seal, comprising a plurality of rotary tip members, a static wear seal member disposed opposite and co-operating with the peripheries of the tip members, said wear seal member comprising a first, honeycomb, part and a second, smooth, part spaced axially from the first part an annular carrier supporting the wear seal member a stator supporting the carrier and defining an annular chamber having radially outer orifices for the admission of an air supply to the chamber, and an annular sheet metal member within the annular chamber having a multiplicity of holes spaced by a small distance from the annular carrier, said annular carrier and said wear seal member having a series of apertures disposed in the zone separating the first and second wear seal parts.

Preferably, when the air supplying the apertures of the said seal derived from the chamber provided in the stator of the seal is cooling air which is cooler than the air supplied directly through the seal derived from its upstream end disposed at the highest pressure side; the first part of honeycomb form of the wear seal member is disposed upstream, with respect to the normal direction of flow of the gases of the turbo-machine, of the second part with a smooth surface.

In contrast and advantageously, when the air supplying the apertures of the said labyrinth seal is hotter than the air flowing directly through the seal from its upstream side, the first part of honeycomb form of the wear seal member is disposed downstream, with respect to the normal direction of flow of the gases of the turbo-machine, of the second part with a smooth surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
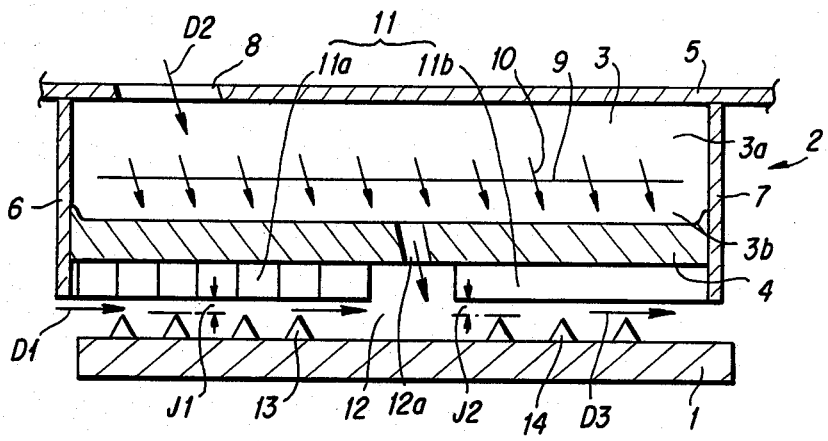
FIG. 1 is a diagrammatic longitudinal section of a part of a turbo-machine comprising a device in accordance with the invention in the case where a seal stator is supplied with cold air.

In FIG. 1, there is illustrated diagrammatically, in axial section, under conditions of stabilised operation, a part of the turbo machine comprising one embodiment of the invention. A labyrinth seal assembly in accordance with the invention is disposed between a fixed part and a rotary part of the turbo-machine.

The rotary part is illustrated diagrammatically by a piece of the rotor 1. The fixed part comprises a stator element 2 connected in known manner to fixed structure of the turbo machine. In this stator element 2 an annular chamber 3 is formed defined by two internal, radially-spaced, members 4 and 5 and by two, axially-spaced, members upstream 6 and downstream 7, upstream and downstream being defined with respect to the normal direction of flow of gases of the turbo machine. The radially outer member 5 has one or more openings 8 for the supply of air. Within the annular chamber 3, at a small distance from the inner member 4, there is provided a thin sheet metal member with a multiplicity of holes 10. This sheet metal member divides the annular chamber 3 into two enclosed spaces, the outer one 3*a* having air inlets 8 and the other internal 3*b*. The inner member 4 of the stator element 2 also serves as an annular carrier on the inner radial face of which one part of the labyrinth seal. According to the invention, the wear seal 11 is in two parts, axially separated by a space 12, an upstream part 11*a* and a downstream part 11*b*.

In the region of space 12, the inner member 4 comprises a series of peripherally-distributed holes 12*a* which constitute orifices for the outlet of air from the annular chamber 3. In the embodiment of the invention illustrated in FIG. 1, the upstream part 11*a* of the wear seal member 11 is in the form of a honeycomb and the downstream part 11*b* is a seal of known type and currently used but having essentially a smooth surface. Opposite each part 11*a* and 11*b* of the wear seal member 11, the rotor 1 carries respectively upstream 13 and downstream 14 lips of which the shape and the number are determined in a well known manner to the man skilled in the art as a function of the operational parameters of the turbo-machine.

The device in accordance to the invention which has just been described enables improved operation under all operational conditions of the turbo-machine, both in a stabilised rating as in transitory ratings, a substantially constant clearance guaranteeing a controlled value of the air flow traversing the labyrinth seal of the turbo-machine incorporating the said device without which variations in clearance will have consequences which are detrimental to the efficiencies of the plant and/or to the working life of certain parts, as a result of flow losses in the zone of the labyrinth seal.

In practice, if a clearance between the upper part of the tips 13 and the surface cooperating with the upstream part 11*a* of the wear seal member 11 is denoted by j1 and the clearance between the upper part of the tips 14 and the cooperating surface of the downstream part 11b of the said wear seal member is denoted by j2, during a rapid acceleration phase up to full gas of the turbo machine, for example, as a result of the combined effects of expansions of mechanical origin under centrifugal action and of thermal origin applied to the various parts of the structure, the clearances j1 and j2 may have a tendancy to decrease.

If the air flow entering at the upstream end into the space separating the rotor piece 1 and the stator element 2 is designated by D1, the air flow entering into the annular chamber 3 through the orifices 8 of the stator element 2, is designated by D2, the point of withdrawal of this air in the turbo machine being selected so that this air will be colder than the temperature of flow D1 entering at the upstream part of the seal, the flow of air leaving the labyrinth seal is designated by D3, in the acceleration phase concerned, the flow D1 has a tendancy to decrease but is subject to a very small variation whilst the flow D3 reduces more rapidly and in a more substantial manner, so that as a consequence a reduction in the cooling air flow D2 from the stator element 2 follows, which in turn causes a heating up and thus an expansion of this part of the stator 2 and consequently the clearances j1 and j2 are reestablished at their initial value. In this manner, the effects tending to reduce the clearances j1 and j2 are compensated and cancelled and the clearances j1 and j2 are maintained at their rated value determined for the optimum results envisaged during stabilised operation of the turbo machine and it will be the same for all operational conditions of the turbo machine tending to reduce the clearances j1 and j2.

In a similar manner, if one passes for example to a deceleration regime of the turbo-machine, the clearances j1 and j2 may have a tendancy to increase. In this case, the flow D1 has a tendancy to increase, but only with a very slight variation, while the flow D3 increases more rapidly to an appreciable degree, as a consequence of an increase in the flow D2 of the cooling air from the stator element 2 follows, which gives rise to a cooling and thus a contraction of the stator member 2 and the clearances j1 and j2 are thus re-established at their initial value. In this way, the effects tending to increase the clearances j1 and j2 are compensated and cancelled out and the clearances j1 and j2 are maintained again at their design value and it will be the same under all operational conditions of the turbo-machine tending to increase the clearances j1 and j2.

It will thus be apparent that for any variation in the conditions of operation of the turbo-machine, a variation in the flow of cold air D2 supplying the annular chamber 3 of the stator member 2 so that the incidence on the clearances j1 and j2 of the labyrinth is in an inverse sense to the variation in the clearances which would result from this variation in conditions. In all cases, the effects are self-compensatory and the device in accordance with the invention procures an automatic mean correction, in real time, in the variations in operation of the clearances j1 and j2 of the labyrinth seal in order to maintain them at their selected design value.

Figure 2:
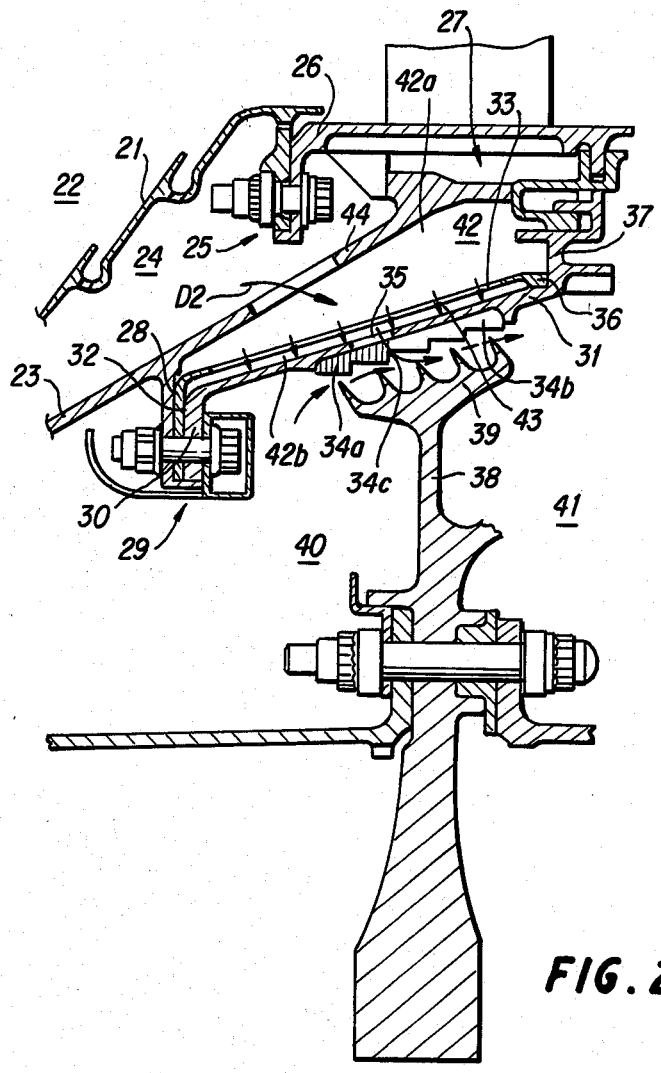
FIG. 2 is a diagrammatic longitudinal section of a part of a turbo-machine comprising a labyrinth seal radially inwardly of the inlet vane guide array of the turbine and provided in accordance with the invention with a device for automatic clearance control of the labyrinth seal, in the case where the stator of the seal is supplied with cold air.

FIG. 2 illustrates an embodiment for an application of the invention to a labyrinth seal placed in the region of the outlet of a combustion chamber of a turbo-machine on the radially inner side. The internal casing 2 of a combustion chamber of annular type denoted generally by 22, has internally thereof an annular envelope defining an enclosure 24 for external cooling of the combustion chamber. The casing 21 is connected at its downstream end by securing means 25, for example of the nut and bolt type, to a radial flange 26 of an internal part associated with the blading of the stator 27. The envelope 23 has a radial flange 28 directed towards the axis of the machine and on which are mounted securing means 29, for example of the nut and bolt type, connected to a radial flange 30 at the end of an annular carrier 31 and a radial flange 32 at the end of a thin sheet metal member 33 with multiple perforations.

The annular carrier 31 is frusto-conical and supports on its radially inner face a wear seal member 34 which is in the form of two axially spaced parts, one upstream part 34*a* constituted by a honeycomb and a downstream part 34*b* having a smooth external surface, these two parts being separated by a space 34*c*. The annular carrier 31 has in the zone of the space 34*c* a series of apertures 35. The thin annular sheet metal member 33 diverges radially slightly outwardly with respect to the carrier 31 with which it is in radial abutment at 36 at its downstream end. At its downstream end, the carrier 31 has a radial-outwardly extending flange 37 and providing a connection with structure inwardly of the stator blades 27.

In the region of the stator part of the machine which has just been described, the rotary part comprises a disc 38 carrying in the example illustrated five annular tip members 39 cooperating with the wear seal member 34. The internal enclosure is divided by the disc 38 into an upstream enclosure 40 where the air is at the pressure P1 and a downstream enclosure 41 where the air is at a pressure P2 less than P1. A space provided between the annular carrier 31 and the envelope 23 of the chamber is constituted by an annular chamber 42 enabling cooling of the annular carrier 31 and is divided into two enclosures 41*a* and 42*b* by the frusto-conical annular sheel metal member 33. This thin sheet metal member 33 comprises a multiplicity of perforations 43 which serve to cool the carrier 31 by impact. An opening 44 provided in the envelope 23 provides for the passage of an air flow D2 from the enclosure 24 of the combustion chamber to the chamber 42.

In this application, an automatic control is effected in real time of the adjustments during operation of the clearance of the labyrinth seal in order to maintain it at the selected design value and the operation enabling the achievement of this result is identical to that which has been described hereinbefore with reference to FIG. 1. As hereinbefore explained, the variations in flow D2 of the cooling air occur in the same sense as the variations in the clearance of the labyrinth seal which enables return of the clearance to the initial value obtained at a stabilised operation.

Figure 3:
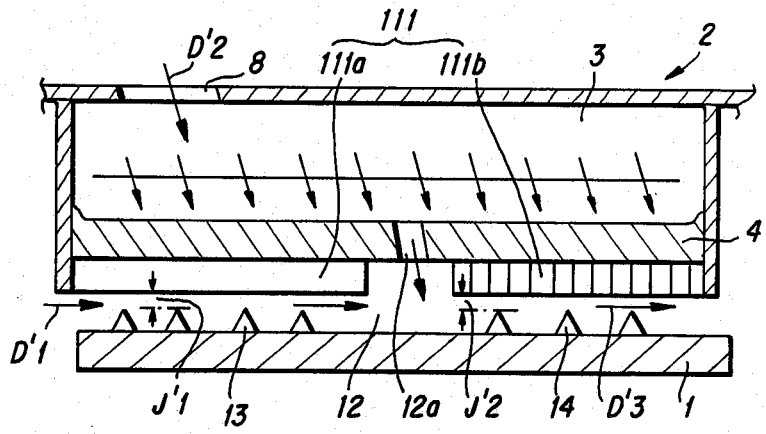
FIG. 3 is a diagrammatic longitudinal section of a part of a turbo-machine comprising a device in accordance with the invention where the stator of the seal is supplied with hot air.

FIG. 3 illustrates diagrammatically a part of a similar turbo machine to that which is illustrated in FIG. 1 and comprising a second embodiment of the invention. For all identical parts the same references have been used as those which are used in FIG. 1 and reference should be made for all the details of the complete description of the device which has been made hereinbefore with reference to FIG. 1. The details specific to the embodiment illustrated in FIG. 3 will now be described. The wear seal member 111 forming part of the labyrinth seal is coposed of two parts, axially separated by a space 12, as hereinbefore. The upstream part 111*a* of the wear seal 111 has a smooth surface and the downstream part 111*b* is constituted by a honeycomb. Furthermore, if the air flow entering the upstream end into the space separating the rotor part 1 and the stator part 2 is designated by D'1, the air flow entering the annular chamber 3 through the orifices 8 of the stator element 2 is designated by D'2, the point of bleed off of this air in the turbo-machine is so selected that the air D'2 is hotter than D'1. The flow of air leaving the labyrinth seal is designated by D'2, the clearance between the annular upper part of the lips 13 and the surface cooperating with the upstream part 111*a* of the wear seal member is designated by j'1 and the clearance between the upper part of the lips 14 and the surface cooperating with the downstream part 111b of the said wear seal is designated by j'2.

The device in accordance with the second embodiment which has just been described likewise enables as in the first embodiment a clearance which is substantially constant at the labyrinth seal, thus guaranteeing a control value of the air flow traversing the said labyrinth seal and enabling the provision of the same advantages hereinbefore referred to.

In practice, during a rapid acceleration phase leading to operation at full gas of the turbo machine, for example, as in the first embodiment, the clearances j'1 and j'2 may have a tendancy to decrease. As a result, the air flow D'3 has a tendancy to decrease but in accordance with a very slight variation while the flow D'1 decreases more rapidly and in a more substantial manner. In turn there is an increase in the flow D'2 of the cooling air from the stator member 2 and thus an expansion of this stator member 2 and as a consequence, the clearances j'1 and j'2 are reestablished at their initial value. As in the first embodiment, the effects tending to decrease the clearances j'1 and j'2 are compensated and cancelled and the clearances j'1 and j'2 are maintained at their design value determined with optimum results required for stabilized operation of the turbo-machine and the same will apply for any operational conditions of the turbo-machine tending to decrease the clearances j'1 and j'2.

In a similar manner, if one passes for example to a deceleration regime of the turbo-machine, the clearances j'1 and j'2 may have a tendancy to increase. In this case, the flow D'3 has a tendancy to increase but only in accordance with a very slight variation whilst the flow D'1 increases more rapidly and in a more substantial manner, there is, as a consequence, a reduction in the flow D'2 of the cooling air from the stator member 2, which gives rise to a contraction in this stator member 2 and as a result, the clearances j'1 and j'2 are re-established at their initial values.

In this way, as in the first embodiment, the effects tending to increase the clearances j'1 and j'2 are compensated and cancelled and the clearances j'1 and j'2 are once again maintained at their design value. It will be the same for all operational conditions of a turbo-machine tending to increase the clearances j'1 and j'2. Thus in all cases, the device according to the invention ensures similarly in the second embodiment an automatic correction means, in real time, in the operational variations of the clearances j'1 and j'2 of the labyrinth in order to maintain them at their selected design value.

Figure 4:
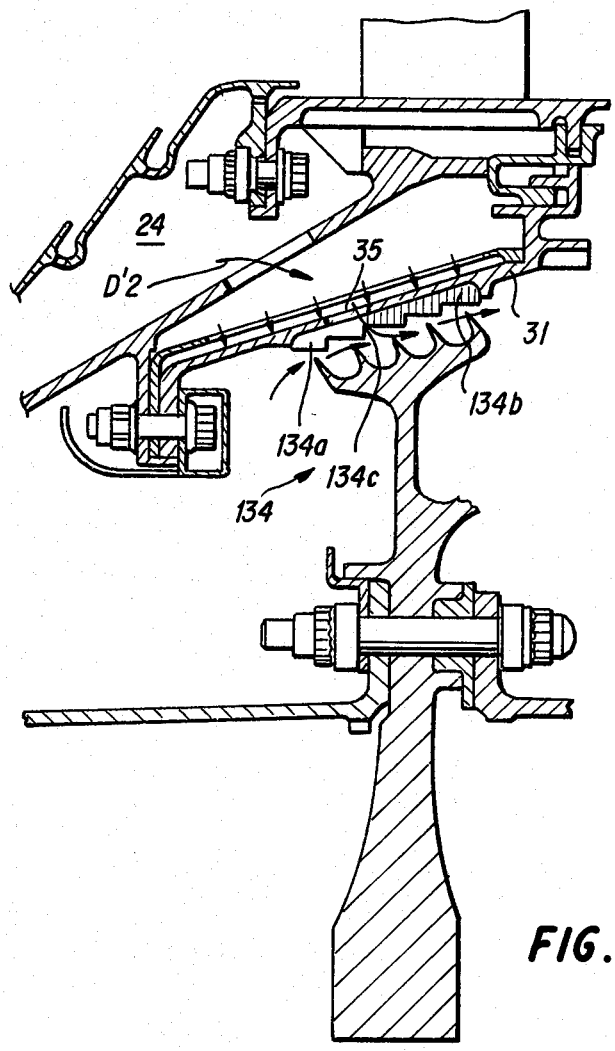
FIG. 4 is a diagrammatic longitudinal section of a part of a turbo-machine comprising a labyrinth seal radially inwardly of the inlet nozzle guide array of the turbine and provided in accordance with the invention with an automatic clearance control device of the labyrinth seal, where the stator of the seal is supplied with hot air.

In a similar manner to the illustration in FIG. 2 of one application of a first embodiment of the invention illustrated in FIG. 1, application of a labyrinth seal disposed in the region of the outlet of the combustion chamber on the radially inner side, FIG. 4 illustrates the same application of the second embodiment of the invention illustrated in FIG. 3. Identical parts have the same reference numerals as those used in FIG. 2. The description will be limited to indicating briefly the particular details resulting from the application of the embodiment of FIG. 3 to a labyrinth seal of the kind illustrated in FIG. 2. The annular carrier 31 is identical and carries on the radially inner face a wear seal member 134 which comprises two parts spaced axially, an upstream part 134*a* having a smooth external surface and a downstream part 134*b* in the form of a honeycomb, these two parts being separated by a space 134*c*. Furthermore, an air flow D'2 for heating up the annular carrier 31 is bled from the enclosure 24 of the combustion chamber.

In this application, there is once again provided an automatic control in real time of the variations during operation of the clearance of a labyrinth seal in order to maintain it adjusted at a selected design value and the operation which enables the provision of this result is identical to that which has been described hereinbefore with reference to FIG. 3. As has been explained hereinbefore, the variations in flow D'2 of the heating up air will be in the inverse sense in the variations in the clearance of the labyrinth seal, which in each case enables return of the clearance to its initial value obtained at stabilized operation.

What is claimed is:

1. In a turbo machine:

a labyrinth seal comprising a plurality of rotary lip members and a wear seal spaced at a clearance from and cooperating with the peripheries of the lip members;

an annular carrier supporting the wear seal;

a stator supporting the carrier; and means for automatically controlling said clearance during various operational states of the turbo machine, comprising:

a first part of said wear seal, being made of honeycomb and having a surface facing said lip members across said clearance, a second part of said wear seal, being spaced axially from said first part to form therebetween an aperture of said wear seal, said second part having a surface facing said lip members across said clearance that is substantially smoother than said surface of said first part.

an annular chamber formed by said stator and said carrier and having radially outer orifices for the admission of an air supply to said annular chamber, there being a series of apertures in said annular carrier communicating said annular chamber with said aperture of said wear seal, and an annular sheet metal member having a plurality of holes therein, disposed within said annular chamber and spaced from said annular carrier by a small distance.

2. A turbo machine as claimed in claim 1, wherein said first part of the wear seal is disposed upstream of said second part, with respect to the normal sense of flow of the gases in the turbo machine, and the said aperture of the wear seal is supplied with cooling air derived from said annular chamber, this air being colder than the are derived directly through the labyrinth seal from its upstream end disposed on the side of the higher pressure.

3. A turbo machine as claimed in claim 1, wherein said first part of the wear seal is disposed downstream of said second part, with respect to the normal direction of flow of the gases in the turbo machine, and said aperture of said wear seal is supplied with hot air derived from said chamber, this air being hotter than the air derived directly through the labyrinth seal from its upstream end disposed on the side of the higher pressure.

* * * * *

UNITED STATES PATENT AND TRADEMARK OFFICE

CERTIFICATE OF CORRECTION

PATENT NO. : 4,662,821

DATED : MAY 5, 1987

INVENTOR(S) : ROBERT KERVISTIN, PHILIPPE J. LEFEBVRE, AND ALAIN F. TEISSIER

It is certified that error appears in the above-identified patent and that said Letters Patent is hereby corrected as shown below:

In column 1, line 8, delete "inevntion" and insert --invention--;

In column 1, line 29, delete "pices" and insert --pieces--;

In column 1, line 30, delete "in" and insert --on--;

In column 1, line 59, delete "maintining" and insert --maintaining--;

In column 2, line 28, delete "labyringth" and insert --labyrinth--;

In column 2, lines 37-38 delete "charac- tersitcs and insert --charac-teristics--;

In column 2, line 63, delete "first part an" and insert --first part, an--;

In column 2, line 64, after "seal member" insert --,--;

In column 4, line 10, after "which" insert -- is secured a wear seal member 11 which constitutes--;

UNITED STATES PATENT AND TRADEMARK OFFICE

CERTIFICATE OF CORRECTION

PATENT NO. : 4,662,821

DATED : MAY 5, 1987

INVENTOR(S) : ROBERT KERVISTIN, PHILIPPE J. LEFEBVRE, AND ALAIN F. TEISSIER

It is certified that error appears in the above-identified patent and that said Letters Patent is hereby corrected as shown below:

In column 4, line 43, delete "tips" and insert --lips--;

In column 4, line 50, delete "tendancy" and insert --tendency--;

In column 4, line 61, delete "ancy" and insert --ency--;

In column 5, line 10, delete "tendancy" and insert --tendency--;

In column 5, line 11, delete "tendancy" and insert --tendency--;

In column 5, line 64, delete "37 and" and insert --37--;

In column 6, line 10, delete "annular sheel" and insert --annular sheet--;

In column 6, line 38, delete "coposed" and insert --composed--;

In column 6, line 49, delete "D'2" and insert --D'3--;

In column 6, line 66, delete "tendancy" and insert --tendency--;

In column 6, line 67, delete "tendancy" and insert --tendency--;

UNITED STATES PATENT AND TRADEMARK OFFICE

CERTIFICATE OF CORRECTION

PATENT NO. : 4,662,821

DATED : MAY 5, 1987

INVENTOR(S) : ROBERT KERVISTIN, PHILIPPE J. LEFEBVRE, AND ALAIN F. TEISSIER

It is certified that error appears in the above-identified patent and that said Letters Patent is hereby corrected as shown below:

In column 7, line 16, delete "tendancy" and insert --tendency--;

In column 7, line 17, delete "tendancy" and insert --tendency--;

In column 8, line 29, delete "of said first part." and insert --of said first part,--;

In column 8, line 46, delete "the are derived" and insert --the air derived--.

Signed and Sealed this

Ninth Day of February, 1988

*Attest:*

DONALD J. QUIGG

*Attesting Officer*

*Commissioner of Patents and Trademarks*